US009926163B2

(12) United States Patent
Chiu

(10) Patent No.: US 9,926,163 B2
(45) Date of Patent: Mar. 27, 2018

(54) ADJUSTABLE TRAY

(71) Applicant: AVISION INC., Hsinchu (TW)

(72) Inventor: Chin-Chu Chiu, Hsinchu County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/141,720

(22) Filed: Apr. 28, 2016

(65) Prior Publication Data

US 2016/0318729 A1 Nov. 3, 2016

(30) Foreign Application Priority Data

May 1, 2015 (TW) ..... 104114051 A

(51) Int. Cl.
*B65H 31/02* (2006.01)

(52) U.S. Cl.
CPC ..... *B65H 31/02* (2013.01); *B65H 2301/4212* (2013.01); *B65H 2405/1111* (2013.01); *B65H 2405/1116* (2013.01); *B65H 2405/11163* (2013.01); *B65H 2405/121* (2013.01); *B65H 2511/10* (2013.01); *B65H 2511/21* (2013.01); *B65H 2801/06* (2013.01)

(58) Field of Classification Search
CPC ..... B65H 2511/21; B65H 2405/1116; B65H 2405/11162; B65H 2405/11163; B65H 2405/1111; B65H 2407/21; B65H 2405/354
USPC ..... 271/9.09; 399/392
See application file for complete search history.

(56) References Cited

U.S. PATENT DOCUMENTS 5,984,300 A * 11/1999 Nishiberi ..... B65H 1/04 271/171
2005/0201794 A1* 9/2005 Suzuki ..... G03G 15/00 399/405
2010/0237556 A1* 9/2010 Azuma ..... B65H 31/02 271/207
2013/0032989 A1* 2/2013 Okuchi ..... B65H 1/04 271/3.14

FOREIGN PATENT DOCUMENTS

TW I255230 B 5/2006

OTHER PUBLICATIONS

Taiwan Office Action dated Sep. 10, 2016 in application No. 104114051.
Taiwan Office Action dated Sep. 10, 2016 in application No. 10521132390.

* cited by examiner

*Primary Examiner* — Jeremy R Severson

(57) ABSTRACT

An adjustable tray includes a first board, a second board and an adjustment component. The second board is pivoted on the first board, and the second board has at least one first position section and at least one second position section. The adjustment component includes a main part and at least one abutted part connected to each other. A first distance is between the first position section and the first board. A second distance is between the second position section and the first board. The first distance is different from the second distance. The main part is movably disposed on the first board for positioning the abutted part at the first position section or the second position section to pivot the second board with a first angle or a second angle between the first board and the second board, and the first angle is different from the second angle.

13 Claims, 9 Drawing Sheets

ADJUSTABLE TRAY

CROSS-REFERENCE TO RELATED APPLICATIONS

This non-provisional application claims priority under 35 U.S.C. § 119(a) on Patent Application No(s). 104114051 filed in Taiwan, R.O.C. on May 1, 2015, the entire contents of which are hereby incorporated by reference.

TECHNICAL FIELD

The disclosure relates to an adjustable tray, more particularly to an adjustable tray for being tilted in different positions.

BACKGROUND

Information was recorded on the paper documents, such as images or handwriting, for the preservation in the past. With the development of digital technology, the information can be recorded in the computers or on the Internet to reduce the space needed for the preservation.

The information on the paper documents is able to be digitalized by a scanner. An automatic paper feeding mechanism of the scanner favorably increases the efficiency of scanning the paper documents. The paper documents are generally output from the scanner to a tray and arranged in a stack after the scanning process.

SUMMARY

According to the disclosure, an adjustable tray includes a first board, a second board and an adjustment component. The second board is pivoted on the first board, and the second board has at least one first position section and at least one second position section. The adjustment component includes a main part and at least one abutted part connected to each other. There is a first distance between the first position section and the first board. There is a second distance between the second position section and the first board. The first distance is different from the second distance. The main part of the adjustment component is movably disposed on the first board for positioning the abutted part at the first position section or the second position section so as to pivot the second board on the first board with a first angle or a second angle between the first board and the second board, and the first angle is different from the second angle.

BRIEF DESCRIPTION OF THE DRAWINGS

The present invention will become better understood from the detailed description given hereinbelow and the accompanying drawings which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
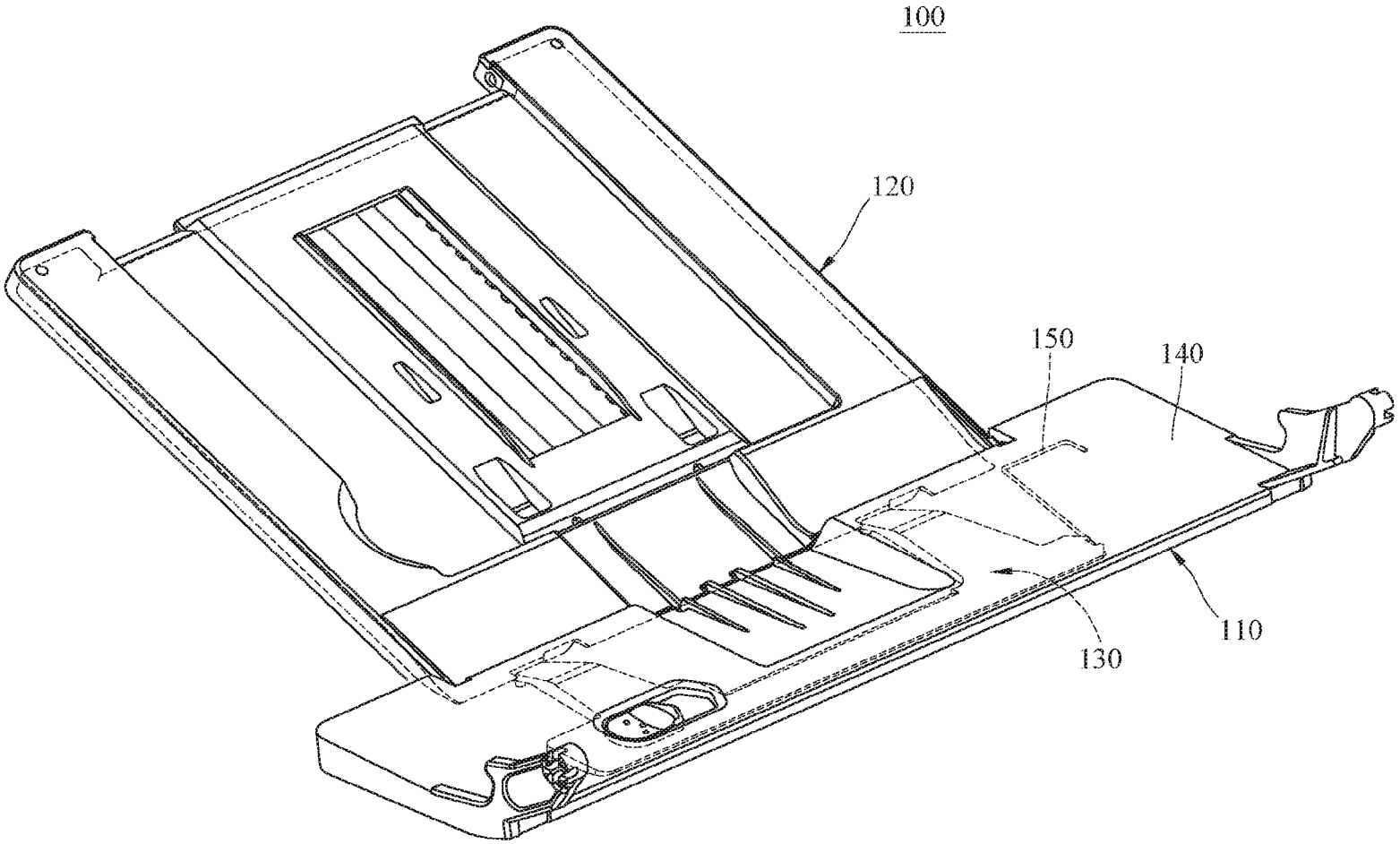
FIG. 1 is a perspective view of an adjustable tray according to a first embodiment.
Figure 2:
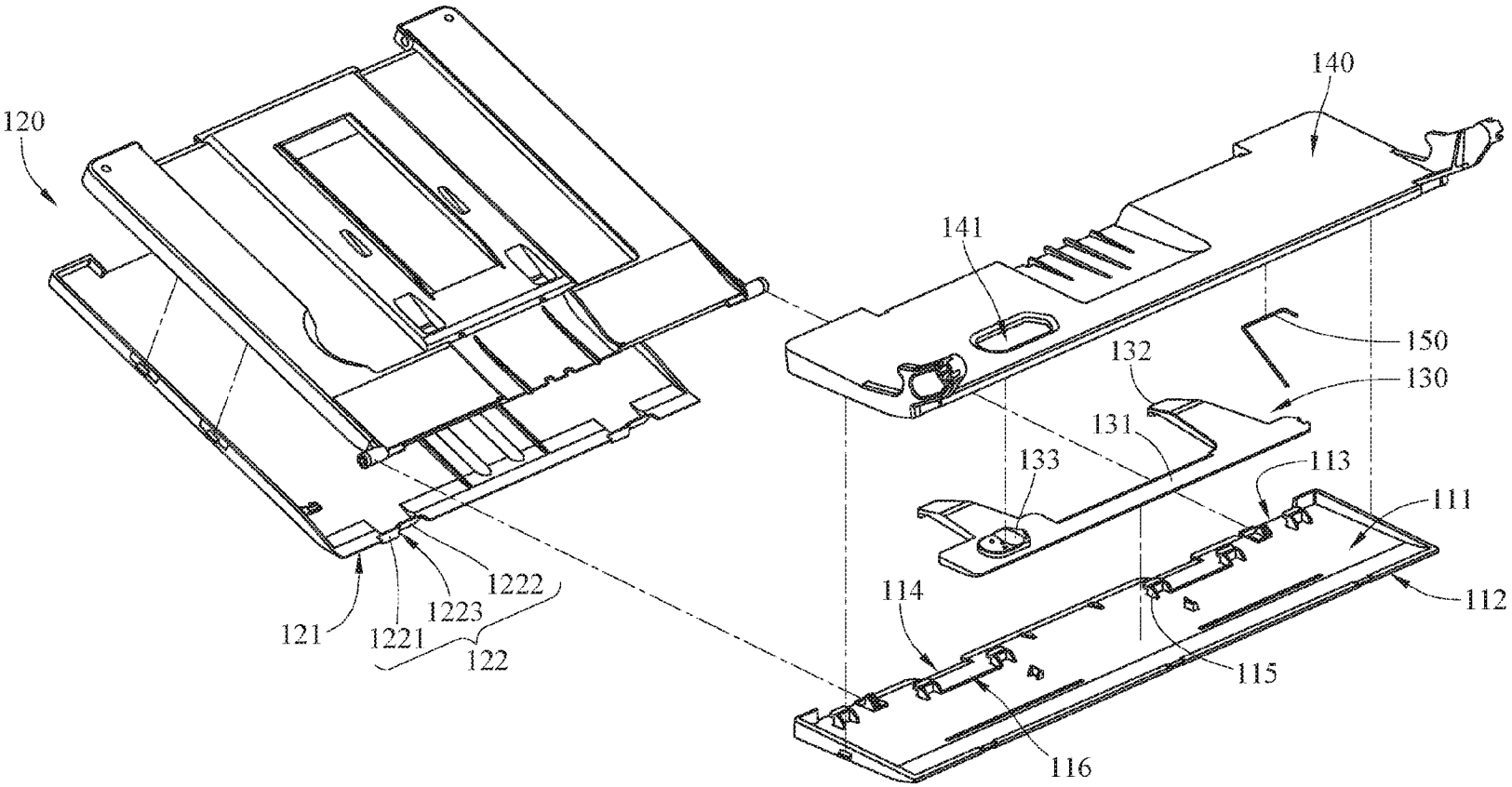
FIG. 2 is an exploded view of the adjustable tray in FIG. 1.

Please refer to FIG. 1 and FIG. 2. FIG. 1 is a perspective view of an adjustable tray according to a first embodiment. FIG. 2 is an exploded view of the adjustable tray in FIG. 1. In this embodiment, an adjustable tray 100 includes a first board 110, a second board 120, an adjustment component 130, a cover 140 and an elastic component 150.

The first board 110 includes a top surface 111, a bottom surface 112, an edge 113, two grooves 114 and a plurality of projections 115. The top surface 111 and the bottom surface 112 are opposite to each other. Two sides of the edge 113 opposite to each other are connected to the top surface 111 and the bottom surface 112, respectively. The two grooves 114 are located at the edge 113, and two opposite sides of each of the grooves 114 are located at the top surface 111 and the bottom surface 112, respectively. The projections 115 are located at the top surface 111 so as to form an accommodation space 116 with the top surface 111 together.

The second board 120 is pivoted on the first board 110 for rotating relative to the first board 110. The second board 120 has an edge 121 and two stepped structures 122. The edge 121 of the second board 120 is close to the edge 113 of the first board 110. Specifically, the edge 121 may be adjacent to the edge 113 or even face the edge 113. Both of the two stepped structures 122 are located at the edge 121. The two stepped structures 122 face the two grooves 114, respectively. Each of the stepped structures 122 has a first position section 1221, a second position section 1222 and a side surface 1223. The side surface 1223 connects the first position section 1221 and the second position section 1222. In this embodiment, the edge 121 of the second board 120 is recessed to a first depth so as to form the first position section 1221, and the edge 121 is recessed to a second depth so as to form the second position section 1222, and the first depth is less than the second depth. There is a first distance between the first position section 1221 and the edge 113 of the first board 110, and there is a second distance between the second position section 1222 and the edge 113, and the first distance can be less than the second distance. Both the first position section 1221 and the second position section 1222 can be a flat surface. Extending directions of the first position section 1221 and the second position section 1222 can be parallel to an extending direction of the edge 121. In other embodiments, the first position section and the second position section can be a curved surface, and the extending directions of the position sections can intersect with the extending direction of the edge of the second board.

The adjustment component 130 is movably disposed on the top surface 111 of the first board 110. In detail, the adjustment component 130 includes a main part 131, two abutted parts 132 and an extending component 133. The main part 131 is movably disposed in the accommodation space 116. The projections 115 of the first board 110 are located at opposite two sides of the main part 131 for limiting a maximum movable distance of the main part 131 relative to the first board 110. Both of the two abutted parts 132 are connected to the main part 131. The two abutted parts 132 are located in the two grooves 114, respectively. A part of the abutted part 132 is protruded from the edge 113 of the first board 110. A length of the part of the abutted part 132 protruded from the edge 113 is greater than or equal to the first distance between the edge 113 and the first position section 1221 and less than or equal to the second distance between the edge 113 and the second position section 1222. A width of the abutted part 132 can be less than a width of the second position section 1222, and the second position section 1222 is recessed from the edge 121 to form a recess so that it is favorable for the abutted part 132 being positioned in the recess. The extending component 133 is protruded from the main part 131 and extends away from the top surface 111.

Figure 3A:
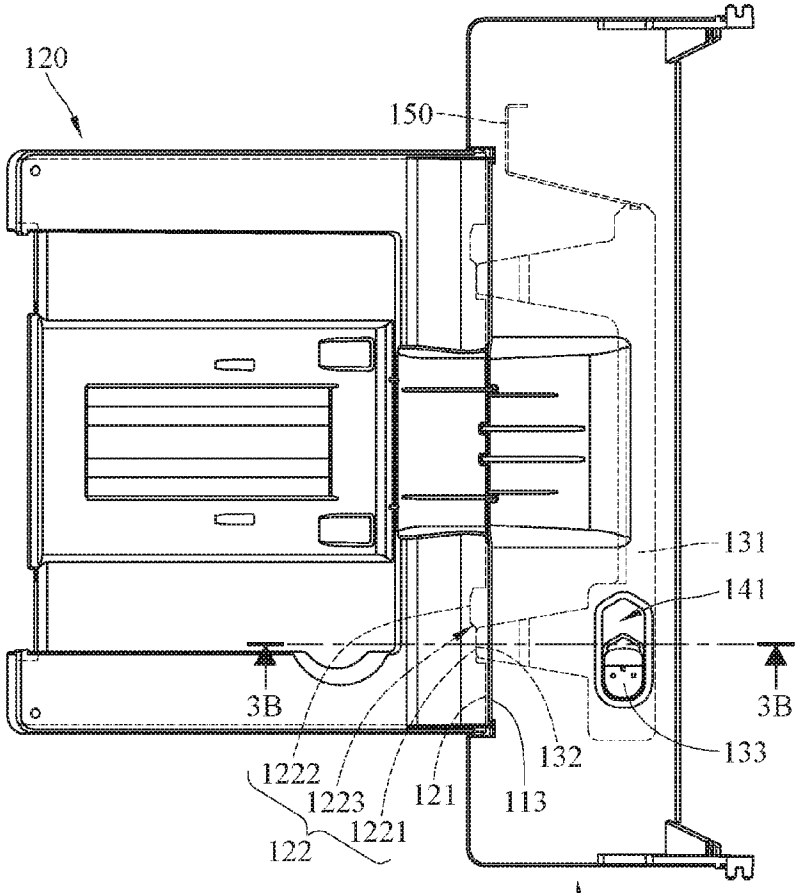
FIG. 3A is a top view of the adjustable tray in FIG. 1 with an abutted part of an adjustment component positioned at a first position section of a second board.
Figure 3B:
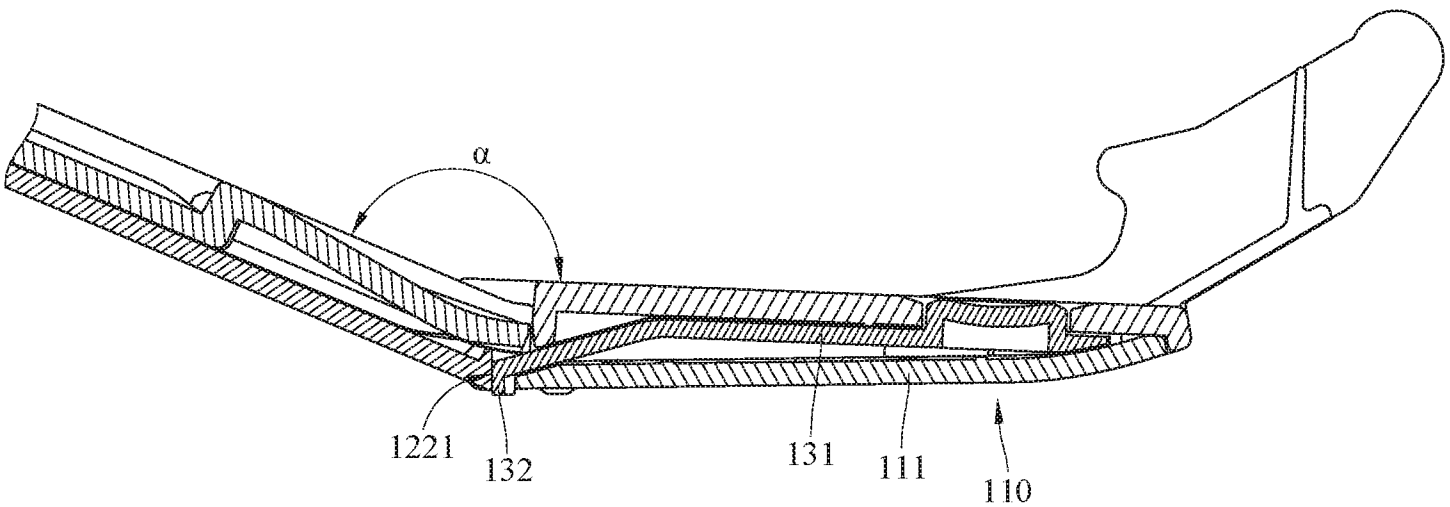
FIG. 3B is a cross-sectional view of the adjustable tray along a line 3B-3B in FIG. 3A.
Figure 4A:
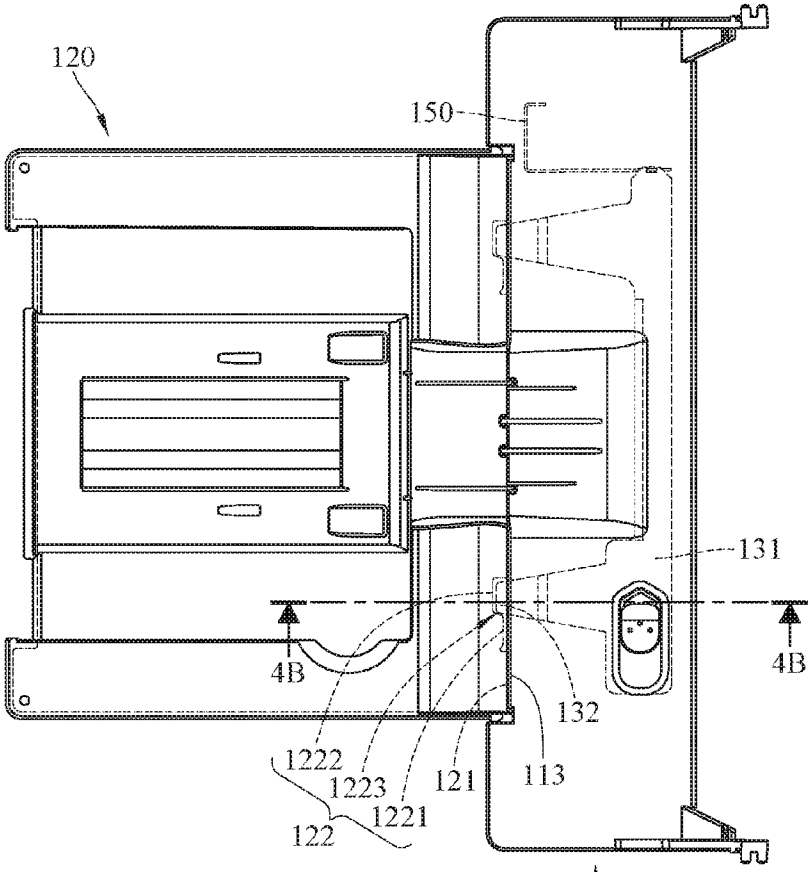
FIG. 4A is a top view of the adjustable tray in FIG. 3A with the abutted part positioned at a second position section of the second board.
Figure 4B:
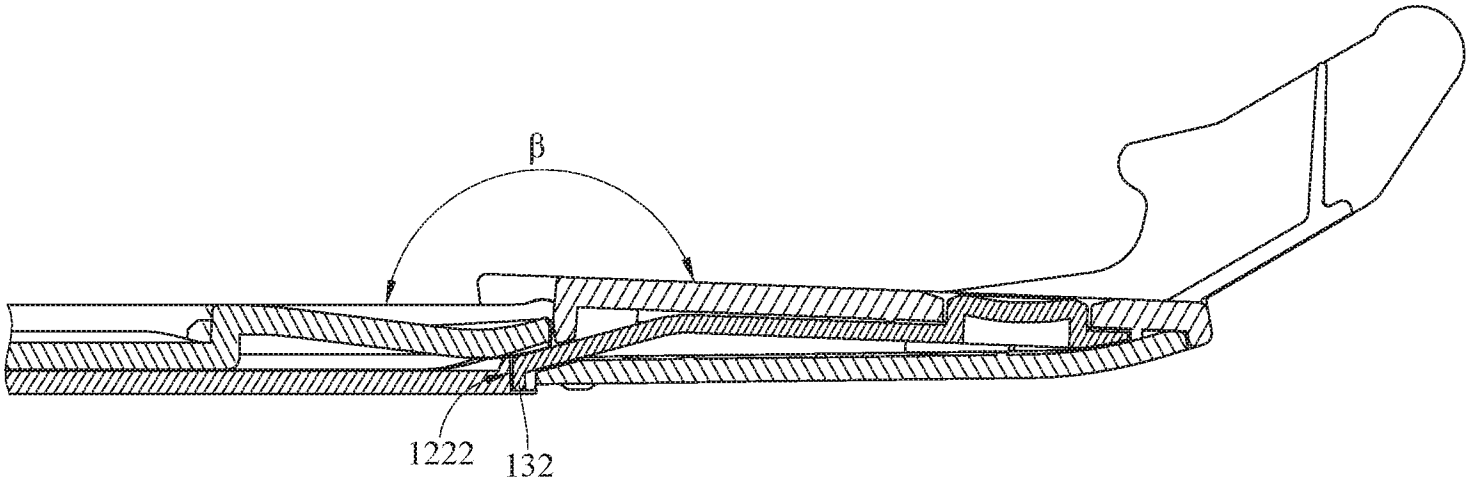
FIG. 4B is a cross-sectional view of the adjustable tray along a line 4B-4B in FIG. 4A.

Please refer to FIG. 2 to FIG. 4B. FIG. 3A is a top view of the adjustable tray in FIG. 1 with an abutted part of an adjustment component positioned at a first position section of a second board. FIG. 3B is a cross-sectional view of the adjustable tray along a line 3B-3B in FIG. 3A. FIG. 4A is a top view of the adjustable tray in FIG. 3A with the abutted part positioned at a second position section of the second board. FIG. 4B is a cross-sectional view of the adjustable tray along a line 4B-4B in FIG. 4A.

As shown in FIG. 3A and FIG. 4A, the main part 131 is movable relative to the top surface 111 of the first board 110 so as to have a first position (as seen in FIG. 3A) and a second position (as seen in FIG. 4A). As shown in FIG. 3B and FIG. 4B, the second board 120 is able to be rotated up and down relative to the first board 110. Directions of rotating up and down are defined when the adjustable tray 100 is viewed from FIG. 3B.

When the main part 131 is moved relative to the top surface 111, the two abutted parts 132 are moved along the two grooves 114, respectively. Since the abutted part 132 is protruded from the edge 113, the step structure 122 moves close to the abutted part 132 gradually when the second board 120 is rotated down. Thus, when the second board 120 is rotated down, the abutted part 132 is firstly abutted against the first position section 1221 which is closer to the abutted part 132 than the second position section 1222.

When the main part 131 is located at the first position, the abutted part 132 is positioned at the first position section 1221. The part of the abutted part 132 protruded from the edge 113 of the first board 110 is abutted against the first position section 1221 so as to stop the rotation of the second board 120 relative to the first board 110, and thereby keeping a first angle α between the first board 110 and the second board 120.

When the main part 131 is located at the second position, the abutted part 132 is positioned at the second position section 1222. The part of the abutted part 132 protruded from the edge 113 of the first board 110 is spaced apart from the first position section 1221 and the second position section 1222 so that rotation of the second board 120 relative to the first board 110 is not restricted by the abutted part 132, and therefore a second angle β is kept between the first board 110 and the second board 120. In this embodiment, the second angle β is larger than the first angle α. Specifically, the second angle β is 180 degrees, but the disclosure is not limited thereto. In other embodiments, the second angle can be larger or smaller than 180 degrees.

The cover 140 covers the top surface 111, and the adjustment component 130 is disposed between the first board 110 and the cover 140. The cover 140 has an opening 141. The extending component 133 of the adjustment component 130 is movably disposed in the opening 141 for adjusting the main part 131 between the first position and the second position. In detail, the extending component 133 can be a protrusion protruded from the opening 141 or a handle standing on the main part 131. When the extending component 133 is a protrusion, a user can pull and/or push the protrusion to move the main part 131 between the first position and the second position. When the extending component 133 is a handle, the user can hold the handle to move the main part 131.

The elastic component 150 is disposed between the first board 110 and the cover 140. Two ends of the elastic component 150 that are opposite to each other are connected to the main part 131 and the cover 140, respectively. When the main part 131 is located at the first position, the abutted part 132 is positioned at the first position section 1221 of the stepped structure 122, and the elastic component 150 is released. When the main part 131 is located at the second position, the elastic component 150 is compressed or expanded by the movement of the main part 131 so as to abut the main part 131 against the side surface 1223, and thereby stop the movement of the main part 131 relative to the first board 110. The elastic component 150 is, for example, a compression spring, a torsion spring or an expansion spring.

In this embodiment, a number of the stepped structure 122 and that of the abutted part 132 are both two, but the disclosure is not limited thereto. In other embodiments, the number of the stepped structure 122 and that of the abutted part 132 can be only one or more than two.

The following illustrates the usage of the adjustable tray 100 in this embodiment. When the user needs to tilt the second board 120 from the first angle α to the second angle β, the user moves the main part 131 from the first position to the second position by the extending component 133 so that the abutted part 132 connected to the main part 131 is moved from a position where the abutted part 132 is abutted against the first position section 1221 to a position where the abutted part 132 is spaced apart from the first position section 1221 and the second position section 1222. Therefore, since the abutted part 132 spaced apart from the position sections 1221 and 1222 does not contact the second board 120, the second board 120 is tilted relative to the first board 110 from the first angle α to the second angle β.

When the user needs to tilt the second board 120 from the second angle β to the first angle α, the user rotates up the second board 120 so as to reduce a touching area between the main part 131 and the side surface 1223. When the second board 120 is rotated continuously, the main part 131 and the side surface 1223 are separated from each other, and the elastic energy of the elastic component 150 is released to drive the abutted part 132 to move to the position where the abutted part 132 is abutted against the first position section 1221. Therefore, the abutted part 132 abutted against the first position section 1221 stops the rotation of the second board 120 relative to the first board 110 and keeps the first angle α between the first board 110 and the second board 120.

Figure 5A:
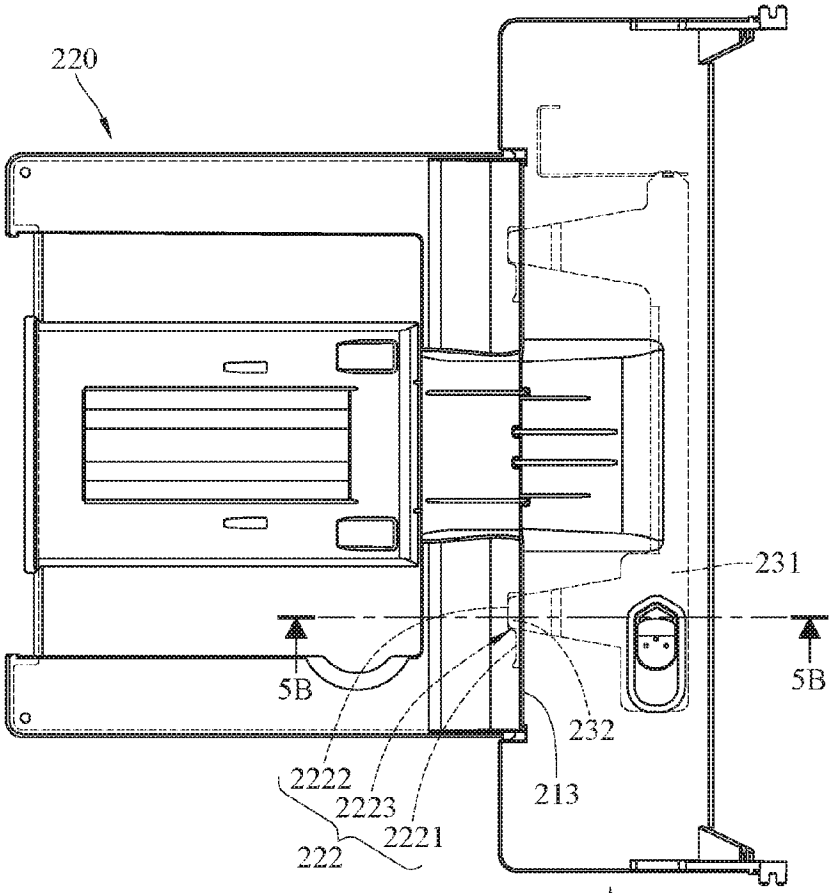
FIG. 5A is a top view of an adjustable tray according to a second embodiment.
Figure 5B:
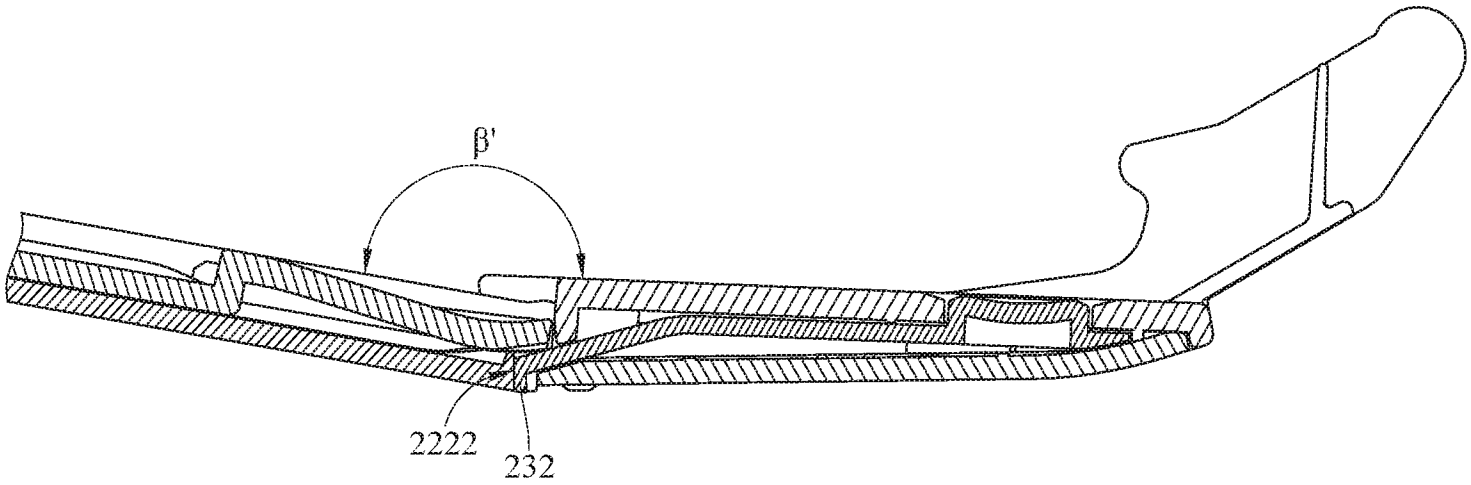
FIG. 5B is a cross-sectional view of the adjustable tray along a line 5B-5B in FIG. 5A.

The following illustrates an adjustable tray in a second embodiment. Please refer to FIG. 5A and FIG. 5B. FIG. 5A is a top view of an adjustable tray according to a second embodiment. FIG. 5B is a cross-sectional view of the adjustable tray along a line 5B-5B in FIG. 5A. Since the second embodiment is similar to the first embodiment, only the differences will be illustrated hereafter.

In this embodiment, the first position section 3221 and the second position section 3222 of the stepped structure 322 are connected to each other. When the main part 231 is located at the first position, the abutted part 232 is positioned at the first position section 2221 of the stepped structure 222. The part of the abutted part 232 protruded from the edge 213 of the first board 210 is abutted against the first position section 2221 so as to stop the rotation of the second board 220 relative to the first board 110 and keep the first angle α between the first board 210 and the second board 220.

When the main part 231 is located at the second position, the abutted part 232 is positioned at the second position section 2222, and the part of the abutted part 232 protruded from the edge 213 of the first board 210 is abutted against the second position section 1222 so as to stop the rotation of the second board 220 relative to the first board 110 and keep a second angle β' between the first board 210 and the second board 220. In this embodiment, the second angle β' is larger than the first angle α, and the second angle β' is smaller than 180 degrees.

In this embodiment, a number of the stepped structure 222 and that of the abutted part 232 are both two, but the disclosure is not limited thereto. In other embodiments, the number of the stepped structure 222 and that of the abutted part 232 can be only one or more than two.

Figure 6:
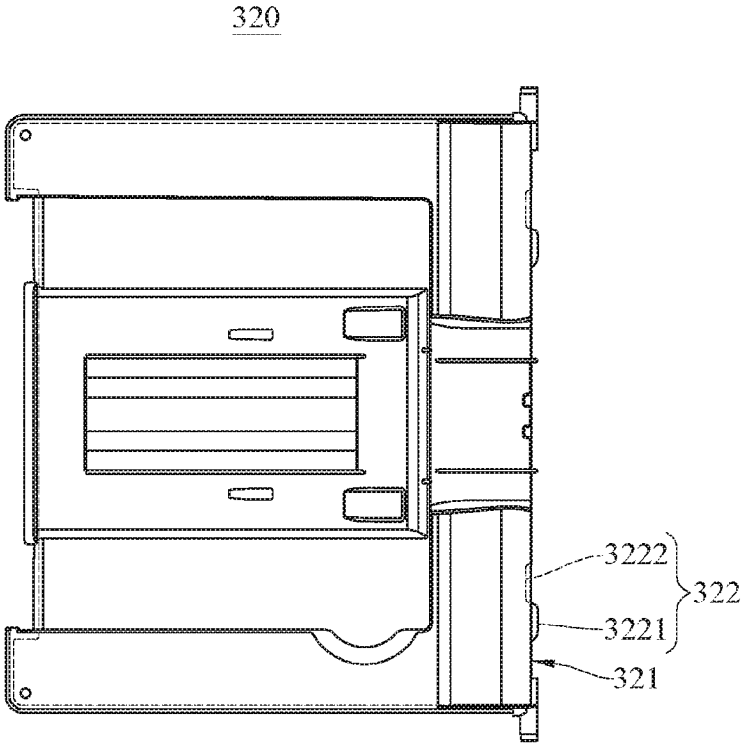
FIG. 6 is a top view of a second board of an adjustable tray according to a third embodiment.

The following illustrates an adjustable tray in a third embodiment. Please refer to FIG. 6, which is a top view of a second board of an adjustable tray according to a third embodiment. Since the third embodiment is similar to the first embodiment, only the differences will be illustrated hereafter.

In this embodiment, the first position section 3221 and the second position section 3222 of the stepped structure 322 are connected to each other. The first position section 3221 is protruded from the edge 321 of the second board 320, and the edge 321 is recessed to a depth so as to form the second position section 3222.

Figure 7:
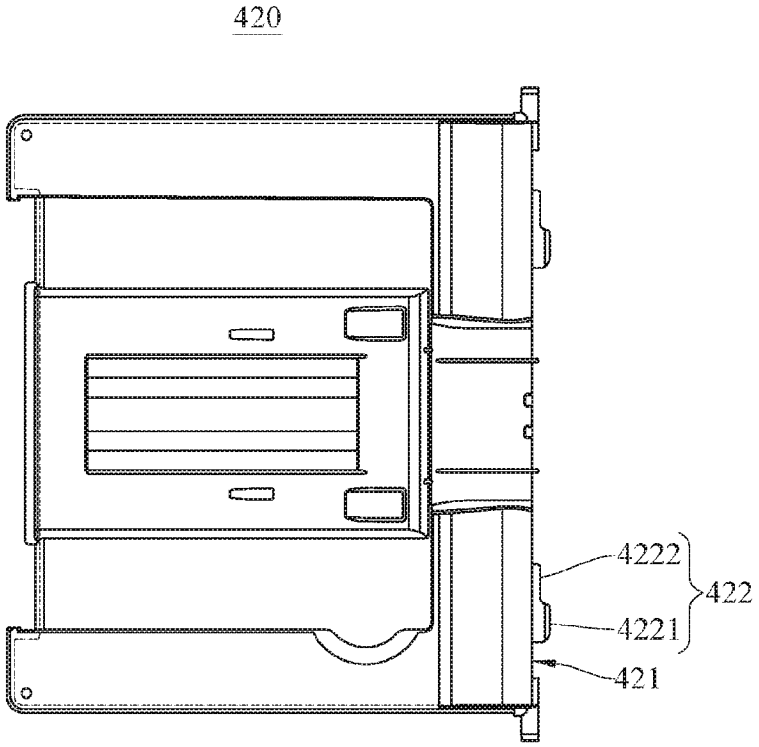
FIG. 7 is a top view of a second board of an adjustable tray according to a fourth embodiment.

The following illustrates an adjustable tray in a fourth embodiment. Please refer to FIG. 7, which is a top view of a second board of an adjustable tray according to a fourth embodiment. Since the third embodiment is similar to the first embodiment, only the differences will be illustrated hereafter.

In this embodiment, the first position section 4221 and the second position section 4222 of the stepped structure 422 are connected to each other. Both the first position section 4221 and the second position section 4222 are protruded from the edge 421 of the second board 420. A distance between the first position section 4221 and the edge 421 is larger than a distance between the second position section 4222 and the edge 421.

In this embodiment, a width of the abutted part is smaller than a width of the second position section 4222 protruded from the edge 421, but the disclosure is not limited thereto. In other embodiments, the width of the abutted part can be larger than a width of the second position section protruded from the edge.

According to the disclosure, the main part is movable relative to the first board so as to position the abutted part at the first position section or the second position section. When the abutted part is positioned at the first position section, the first angle is kept between the first board and the second board. When the abutted part is positioned at the second position section, the second angle which is different from the first angle is kept between the first board and the second board. Therefore, the user is able to tilt the second board in a position with the first angle and another position with the second angle according to the scanning condition and the size of paper documents so that it is favorable for properly arranging the paper documents, and thereby preventing messy and disorder paper arrangement or paper jamming.

What is claimed is:

1. An adjustable tray, comprising:

a first board;

a second board pivoted on the first board, the second board having at least one first position section and at least one second position section; and an adjustment component comprising a main part and at least one press protrusion connected to each other, the at least one press protrusion protruding from the main part and extending towards the second board;

wherein there is a first distance between the at least one first position section and the first board, there is a second distance between the at least one second position section and the first board, and the first distance is different from the second distance; the main part of the adjustment component is movably disposed on the first board for positioning the at least one press protrusion at the at least one first position section or the at least one second position section so as to pivot the second board on the first board with a first angle or a second angle between the first board and the second board, and the first angle is different from the second angle.

2. The adjustable tray according to claim 1, wherein the at least one first position section is connected to the at least one second position section.

3. The adjustable tray according to claim 1, wherein the second board has an edge close to the first board, both the at least one first position section and the at least one second position section are located at the edge of the second board, and the first distance is less than the second distance.

4. The adjustable tray according to claim 3, wherein the edge of the second board is recessed to a first depth so as to form the at least one first position section, the edge of the second board is recessed to a second depth so as to form the at least one second position section, and the first depth is less than the second depth.

5. The adjustable tray according to claim 4, wherein a width of the at least one press protrusion is less than a width of the at least one second position section.

6. The adjustable tray according to claim 4, wherein when the at least one press protrusion is positioned at the at least one first position section, the at least one press protrusion is abutted against the at least one first position section so as to keep the first angle between the first board and the second board; when the at least one press protrusion is positioned at the at least one second position section, the at least one press protrusion is spaced apart from the at least one first position section and the at least one second position section so as to keep the second angle between the first board and the second board.

7. The adjustable tray according to claim 1, wherein the second board has an edge close to the first board, the at least one first position section is protruded from the edge, and the at least one second position section is recessed from the edge.

8. The adjustable tray according to claim 1, wherein a number of the at least one press protrusion is two, both of the two press protrusions are connected to the main part, a number of the at least one first position section and that of the at least one second position section are both two, and the two press protrusions are respectively abutted against the two first position sections or respectively abutted against the two second position sections.

9. The adjustable tray according to claim 1, further comprising a cover covering the first board, wherein the cover has an opening, the adjustment component is disposed between the cover and the first board, the adjustment component further comprises an extending component for adjusting a position of the adjustment component, the extending component is connected to the main part, and the extending component is located in the opening.

10. The adjustable tray according to claim 9, further comprising an elastic component, wherein two ends of the elastic component that are opposite to each other are respectively connected to the cover and the main part so that the at least one press protrusion is normally positioned at the at least one first position section.

11. The adjustable tray according to claim 10, wherein the elastic component presses the main part when the at least one press protrusion is located at the at least one second position section so that the at least one press protrusion is abutted against a side surface of the second board connecting the at least one first position section and the at least one second position section, and thereby preventing the main part from moving relative to the first board.

12. The adjustable tray according to claim 1, wherein the first board has an edge and at least one groove, the edge is close to the second board, the at least one groove is located at the edge, and the at least one press protrusion is located in the at least one groove.

13. The adjustable tray according to claim 1, wherein the first board comprises a plurality of projections located at opposite two sides of the main part for limiting a maximum movable distance of the main part relative to the first board.

* * * * *